United States Patent [19]

Crum

[11] Patent Number: 4,901,609

[45] Date of Patent: Feb. 20, 1990

[54] ADJUSTABLE PLIERS

[75] Inventor: David L. Crum, Houston, Tex.

[73] Assignee: Compaq Computer Corporation, Houston, Tex.

[21] Appl. No.: 348,057

[22] Filed: May 5, 1989

[51] Int. Cl.[4] ..... B25B 7/04

[52] U.S. Cl. ..... 81/405; 81/409.5; 81/411

[58] Field of Search ..... 81/394, 405, 409.5, 81/411

[56] References Cited

U.S. PATENT DOCUMENTS

| | | | |
|---|---|---|---|
| 4,232,573 | 11/1980 | Dace | 81/411 X |
| 4,269,089 | 5/1981 | Hastings | 87/411 X |
| 4,581,960 | 4/1986 | Putsch et al. | 81/394 X |
| 4,726,265 | 2/1988 | Reich | 81/411 |
| 4,773,288 | 9/1988 | Jang et al. | 81/409.5 |

*Primary Examiner*—James G. Smith

*Attorney, Agent, or Firm*—Arnold, White & Durkee

[57] ABSTRACT

A pair of adjustable pliers 10 is comprised of first and second plier halves 14, 16 pivotally and slideably joined together by a nut and bolt-type combination 18 fixed to the first plier half 14 and extending through a slot 23 in the second plier half 16. The second plier half 16 includes a series of arcuate grooves 24 cut into its interior surface, facing the first plier half 14. Correspondingly, the first plier half 14 includes an arcuate raised portion 28 that dimensionally matches and is pivotable within each of the arcuate slots 24. To adjust the jaw portions 21, 22 of the pliers 10, the arcuate raised portion 28 is selectively engaged with one of the series of arcuate grooves 24. In order to engage the arcuate raised portion 28 with a selected one of the arcuate grooves 24, the pliers 10 are manipulated to a fully open, adjusting position where the arcuate raised portion 28 disengages the arcuate grooves 24 and is positioned substantially parallel to the slot 23. In this position, the plier halves 14, 16 are slideable to the desired position. A ball-type latch 40 is secured to the first plier half 14 and extends in a direction generally toward the second plier half 16. A plate 30 is attached to the second plier half 16 and includes a linear groove 38 substantially parallel to the slot 23. When the plier halves 14, 16 are manipulated to the fully open, adjusting position, the ball-type latch 40 engages the linear groove 38 so as to urge the plier halves 14, 16 to remain in this fully open, adjusting position, thereby guiding the plier halves 14, 16 along a desired adjusting path.

20 Claims, 2 Drawing Sheets

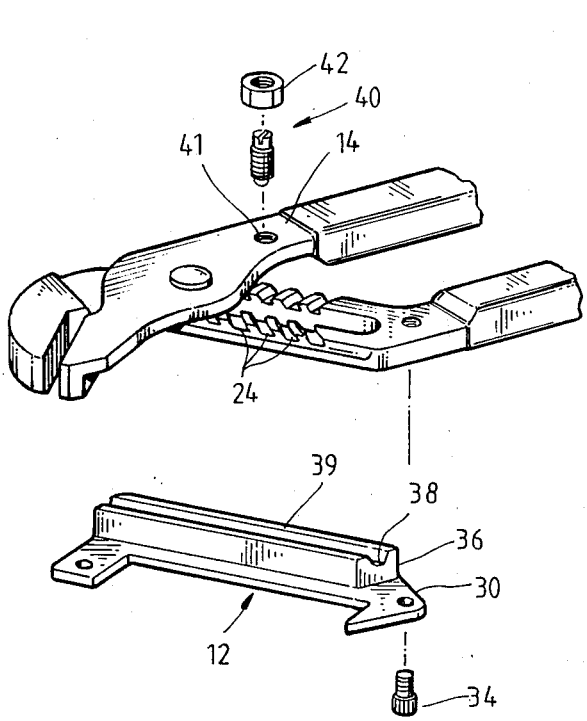
FIG. 3
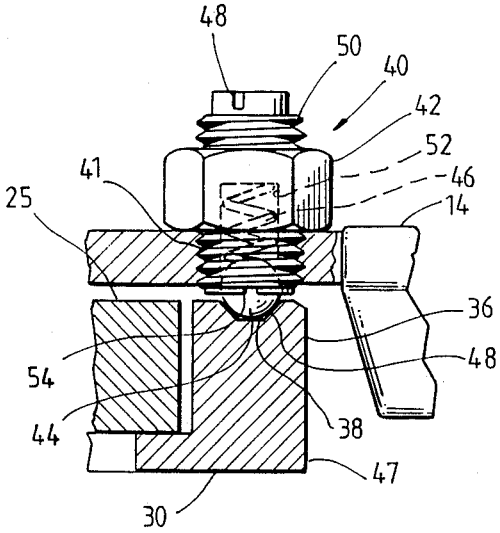
FIG. 5
FIG. 4
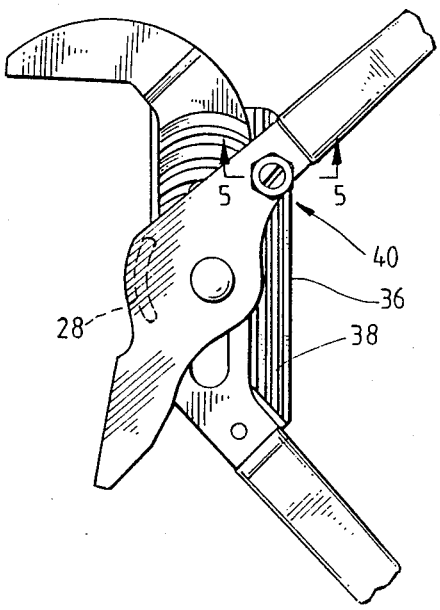

ADJUSTABLE PLIERS

BACKGROUND OF THE INVENTION

1. Field of the Invention

This invention relates generally to pliers that have jaws adjustable to a plurality of preselected positions and, more particularly, to an apparatus for maintaining the two halves of the pliers in a preselected desired position to facilitate altering the jaws from one preselected position to another.

2. Description of the Related Art

Various tool manufacturers produce pliers having jaws that are adjustable to a plurality of preselected positions, such as, the Channel Lock Corporation, which manufacturers adjustable pliers under the trade name CHANNEL LOCK. The jaws of these pliers are adjustable to a plurality of preselected positions via a series of parallel arcuate grooves cut into the interior surface of one of the plier halves. A matching arcuate raised portion on the interior surface of the opposite half of the pliers mates with any selected one of the arcuate grooves to provide a series of positions that correspond to a preselected series of jaw dimensions. The arcuate raised portion, of course, slideably engages the arcuate grooves so as to position the plier halves at a preselected position corresponding to a preselected position of the jaws.

However, in order to engage the arcuate raised portion with one of the parallel arcuate grooves, the pliers are typically manipulated to a fully open position, where the arcuate raised portion disengages from the arcuate grooves, thereby allowing the plier halves to slide relative to one another. The raised arcuate portion moves in a direction generally perpendicular to the arcuate grooves. This movement, however, has a tendency to cause the arcuate raised portion to engage the end portions of the arcuate grooves so as to make sliding adjustment of the plier halves difficult.

Additionally, once the adjustable pliers are manipulated to a preselected position, it is likely that the user will desire that the adjustable pliers remain in this position for an extended period of time. However, quite often the user will pick up the adjustable pliers by a single handle, thereby causing the plier halves to pivot to their fully open, adjusting position and allowing the plier halves to slide from the preselected desired position. It is preferable that the plier halves be restricted from inadvertently moving to the fully open, adjusting position unless specifically desired by the user.

The present invention is directed to overcoming one or more of the problems as set forth above.

SUMMARY OF THE INVENTION

The primary object of the present invention is to provide adjustable pliers that are easily adjustable to a plurality of preselected positions.

Another object of the present invention is to provide adjustable pliers that have an apparatus for maintaining the opposing halves of the pliers in a preselected adjusting position so as to allow for easy adjustment of the pliers to a plurality of preselected positions.

Yet another object of the present invention is to provide adjustable pliers that have an apparatus for preventing movement of the opposing halves of the pliers to the preselected adjusting position so as to prevent inadvertent adjustment of the plier halves.

To attain these and other objectives an apparatus is provided for maintaining first and second halves of an adjustable pliers in a preselected adjusting position whereby the first and second halves of the adjustable pliers are free for sliding motion relative to one another along a path for adjusting the dimension of the pliers jaws. The apparatus includes a ball-type latch connected to the first plier half and extending in a direction generally toward the second plier half. The ball-type latch is movable between first and second preseleted positions and urged toward the second position. A plate is connected to the second plier half and has a groove extending a preselected depth into the plate and along the surface of the plate substantially parallel to the adjusting path. The plate is disposed a preselected distance from the first plier half at a location approximately corresponding to the first preselected position of the ball-type latch. The preselected depth of the groove approximately corresponds to the second preselected position of the ball-type latch. Thus, the ball-type latch engages the groove and allows the first and second plier halves to slidingly adjust while being guided by the ball moving along the groove.

BRIEF DESCRIPTION OF THE DRAWINGS

Other objects and advantages of the invention will become apparent upon reading the following detailed description and upon reference to the drawings in which:

FIG. 3 is a disassembled perspective view of the instant apparatus relative to the adjustable pliers;

FIG. 4 is a side view of the adjustable pliers and the instant apparatus arranged in the fully open, adjusting position; and FIG. 5 is a partial cross sectional view of the adjustable pliers and the instant apparatus in the fully open, adjusting position.

Figure 1:
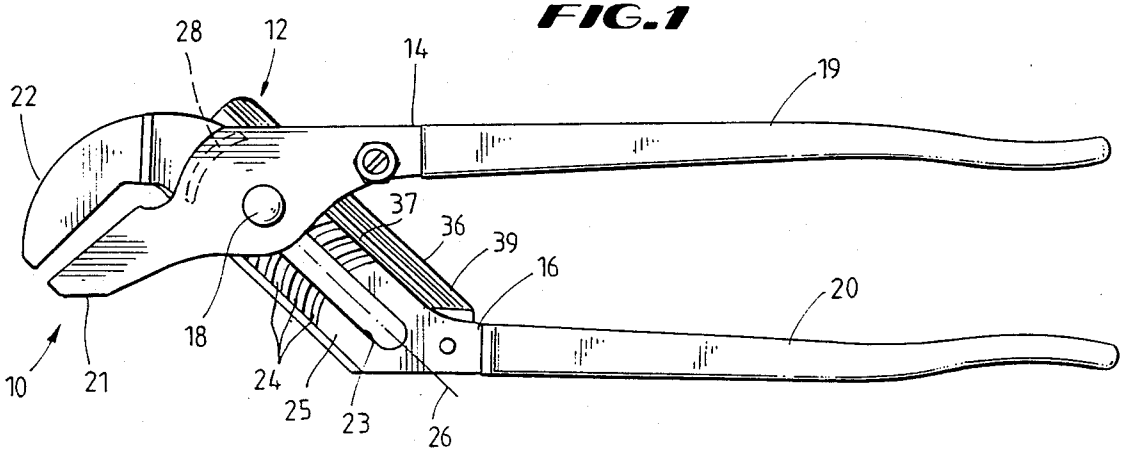
FIG. 1 is a first side view of the adjustable pliers and the instant apparatus.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENT

Figure 2:
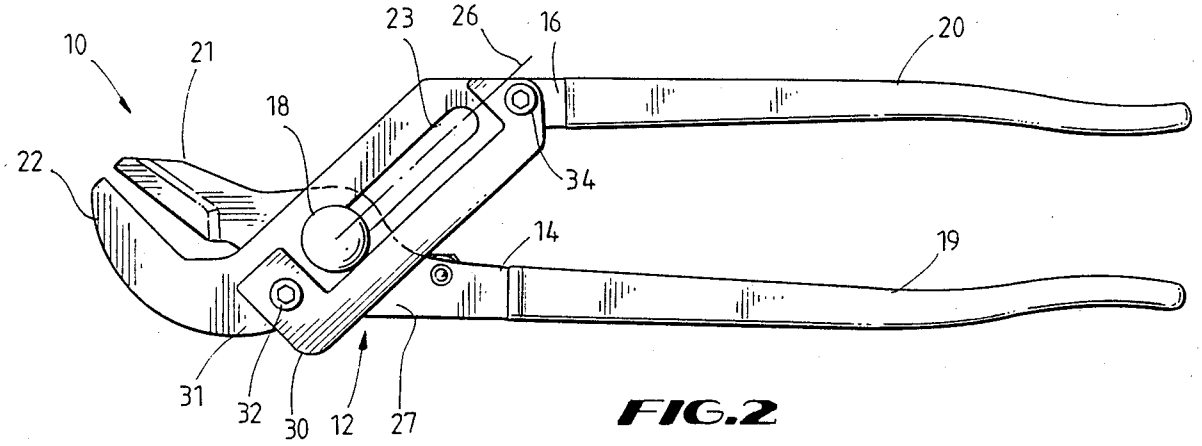
FIG. 2 is an opposite side view of the adjustable pliers and the instant apparatus.

Turning now to the drawings and referring simultaneously to FIGS. 1 and 2, a first side view of the adjustable pliers 10 and apparatus 12 and the opposing side view are respectively shown. The adjustable pliers 10 includes first and second plier halves 14, 16 pivotally joined together by a nut and bolt type combination 18. Each plier half 14, 16 includes a handle portion 19, 20 and a jaw portion 21, 22. The handle portions 19, 20 are, of course, gripped by a user of the pliers 10 while the jaw portions 21, 22 are used to grasp objects, such as pipes, nuts, bolts, etc.

The nut and bolt type combination 18 is typically fixed to one of the plier halves 14, 16, such as the first plier half 14. The nut and bolt type combination 18 can be fixed to the first plier half 14 in a variety of ways, such as welding, threading, or integral formation therewith.

In the preferred embodiment, the bolt type combination 18 is press fitted into a bore extending through the first plier half 14.

The second plier half 16 includes a slot 23 generally positioned within a central portion of the second plier half 16 and having a width substantially identical to the exterior dimension of the bolt portion of the nut and bolt type combination 18. An enlarged head 24 of the nut and bolt type combination 18 has a diameter slightly greater than the dimension of the slot 23, thereby capturing the second half 16 of the pliers 10 in close, mating relationship with the first half 14 of the pliers 10. Thus, it can be seen that the first and second plier halves 14, 16 are pivotable in a scissors-like action relative to one another about the center-point of the nut and bolt type combination 18, as well as being slidably adjustable so that the nut and bolt type combination 18 freely moves along the slot 23. Movement of the plier halves 14, 16 along the slot 23 correspondingly results in variations in the dimensions of the jaw portions 21, 22 of the plier halves 14, 16.

In order to prevent unrestricted sliding movement of the plier halves 14, 16 or, more particularly, to secure the plier halves 14, 16 at a preselected location, the second half 16 of the pliers 10 includes a series of parallel, arcuate grooves 24 cut into its interior surface 25 substantially perpendicular to the centerline 26 of the slot 23. The facing surface 27 of the first plier half 14 includes a corresponding arcuate raised portion 28 that dimensionally matches the arcuate grooves 24. The centerpoints of the parallel arcuate grooves 24 and the arcuate raised portion 28 correspond to the center line 26. Moreover, the centerpoint of the arcuate raised portion 28 also corresponds to the centerpoint of the nut and bolt type combination 18. Therefore, by positioning the nut and bolt type combination 18 to coincide with the centerpoints of each of the parallel arcuate grooves 24, the arcuate raised portion 28 engages the corresponding parallel arcuate groove 24 to prevent sliding motion between the plier halves 14, 16 while still allowing for pivotal motion therebetween.

In order to facilitate movement of the arcuate raised portion 28 to selected ones of the arcuate grooves 24, the plier halves 14, 16 must be manipulated to their fully open, adjusting position. Thus, it can be seen that by manipulating the plier halves 14, 16 to their fully open position, where the jaw portions 21, 22 are at their greatest pivotal distance apart, the arcuate raised portion 28 disengages the arcuate grooves 24, allowing the plier halves 14, 16 to slide relative to one another. The pliers 10 are illustrated in FIG. 4 in the fully open, adjusting position. When the jaws 21, 22 are positioned at the desired distance apart, the arcuate raised portion 28 is engaged with the appropriate arcuate groove 24 by pivoting the handle and jaw portions 19, 20, 21, 22 in a direction toward one another, thereby establishing the desired relative positions of the jaws 21, 22. In this manner, adjustable pliers 12 are useful for grasping objects of various sizes.

The apparatus 12 includes a plate 30 attached to the exterior surface 31 of the second plier half 16. In the preferred embodiment, the plate 30 is attached via a pair of allen screws 32, 34. The plate 30 includes a raised portion 36 that extends from the surface of the plate 30 a sufficient distance so as to form a surface 39 substantially co-planar with the interior surface 25 of the second plier half 16. Further, the raised portion 36 is substantially adjacent end portions 37 of the series of arcuate grooves 24.

While the preferred embodiment contemplates the plate 30 being formed separate from the second plier half 16, it is also contemplated that the plate 30 and, in particular, the raised portion 36 could be integrally formed with the second plier half 16 without departing from the spirit and scope of the instant invention.

An enhanced view of the apparatus 12 and, in particular, the plate 30 is shown in the exploded illustration of FIG. 3. A linear groove 38 is cut into the co-planar surface 39 of the raised portion 36. The groove 38 is generally parallel to the longitudinal center line 26 of the slot 23 and is located so as to engage a spring loaded ball-type latch 40 when the plier halves 14, 16 are manipulated to the fully open, adjusting position. The linear groove 38 has a substantially v-shaped cross sectional configuration with a flat bottom portion that accepts the ball-type latch 40.

The spring loaded ball-type latch 40 is shown in detail in FIG. 5 fixed to the first half 14 of the pliers 10. A threaded bore 41 extends through the first plier half 14, the ball-type latch 40 is threaded through the bore 41, and a locknut 42 is threadably attached to the ball type latch 40 and engages the exterior surface of the first plier half 14. A ball 44 of the ball-type latch 40 extends from the interior surface of the first half 14 of the pliers 10 a sufficient distance so as to engage the bottom surface of the linear groove 38. Further, a coil spring 46 is housed within the ball-type latch 40 and positioned so as to urge the ball 44 in a direction generally away from the first plier half 14 toward the second plier half 16. The location of the ball-type latch 40 corresponds to the location of the linear groove 38 when the pliers 10 are in their fully open, adjusting position. That is to say, when the pliers 10 are manipulated to their fully open, adjusting position, the ball-type latch 40 engages the linear groove 38 so as to maintain the plier halves 14, 16 in this fully open, adjusting position.

In this manner, the groove 38 and ball-type latch 40 interact to urge the pliers 10 to remain in the adjusting position. Thus, slideable motion between the plier halves 14, 16 is guided by the combination of the slot 23 and the linear groove 38. Sliding motion of the plier halves 14, 16 causes the ball-type latch 40 to ride along the linear groove 38 until the desired position is reached. Once this desired position is reached, the ball-type latch 40 is readily disengaged from the linear groove 38 by rotating the plier halves 14, 16 in a direction toward one another. Sufficient force is required to cause the ball 44 to compress the coil spring 46. Compression of the coil spring 46 by a sufficient distance results in the ball 44 disengaging the linear groove 38, thereby allowing pivotal movement of the plier halves 14, 16.

Compression of the coil spring 46 is, of course, effected by the ball 44 sliding up the sloped surface 48, which forms one side of the linear groove 38. Clearly, once the plier halves 14, 16 have been rotated a sufficient distance so as to move the ball-type latch 40 away from the raised portion 36, the coil spring 46 urges the ball 44 in a direction away from the first plier half 14. Thus, when the user again desires to alter the position of the jaw portions 21, 22, he will once again simply rotate the plier halves 14, 16 to their fully open, adjusting position. As the ball 44 has been urged toward its fully extended position by the spring 46, it will once again be forced into the ball-type latch 40 as it travels over the raised portion 36 and into the groove 38.

Also, the raised portion 36 extends from the second plier half 16 a sufficient distance so that its exterior surface 47 engages the ball-type latch 40 and prevents the plier halves 14, 16 from moving to the fully open, adjusting position unless sufficient force is applied to overcome the force exerted by the spring 46. In this manner, the exterior surface 47 of the raised portion 36, interacts with the ball-type latch 40 to prevent inadvertent removal of the arcuate raised portion 28 from the selected arcuate groove 24. Therefore, once the user has selected a position, the adjustable pliers 10 will remain in that position unless he purposefully urges the plier halves 14, 16 to the fully open, adjusting position.

The utility of this feature may best be appreciated by considering the manner in which the adjustable pliers 10 are ordinarily used. Commonly, a user of the adjustable pliers 10 manipulates the plier halves 14, 16 to their fully open, adjusting position and selects the arcuate groove 24 that corresponds to the desired position of the jaw portions 21, 22. Once this desired position is selected, the user typically does not wish to readjust the pliers for an extended period of time. However, the user typically lays the pliers 10 aside while he performs other related tasks not requiring the adjustable pliers 10. When the user again requires the use of the adjustable pliers 10, he will occasionally pick up the pliers 10 by grasping one of the handle portions 19, 20 of the plier halves 14, 16. Thus, the extended handle portions 19, 20 causes the ungrasped handle portion 19, 20 to have a greater moment arm than the corresponding jaw portion 21, 22. This, of course, results in the ungrasped plier half 14, 16 pivoting to the fully open, adjusting position thereby causing the plier halves 14, 16 to slip from the position previously selected by the user. This causes unnecessary delay while the user repositions the plier halves 14, 16 to the desired position. In the instant apparatus 12, contact between the ball-type latch 40 and exterior surface 47 of the raised portion 36 prevents the plier halves 14, 16 from being inadvertently positioned in the fully open, adjusting position, thereby preserving the selected position of the plier halves 14, 16.

The ball-type latch 40 includes a slot 48 extending diametrically across its upper surface. The slot 48 is readily engagable by such tools as a screwdriver for adjusting the position of the ball-type latch 40 by rotating the ball-type latch 40 in a clockwise or counterclockwise direction. In this manner, the position of the ball 44 can be altered to ensure that the ball 44 fully engages the groove 38, or to adjust the force required to move the ball 44 into or out of the groove 38. It should be appreciated that by rotating the ball-type latch 40 in a counterclockwise direction, the position of the ball 44 is moved in a direction toward the first plier half 14 such that less compression of the spring 46 will be required to move the ball 44 into or out of the groove 38. Conversely, to increase the force required to move the plier halves 14, 16 into or out of the fully open, adjusting position, the user simply rotates the ball-type latch 40 in the clockwise direction so as to move the ball 44 in a direction away from the first plier half 14. This movement increases the compression of the spring 46 that must be accomplished to move the ball 44 over the raised portion 36 and into the groove 38.

The spring loaded ball-type latch 40 is preferably constructed from a set screw 50 that has a longitudinal bore 52 opening onto a first end portion of the set screw 50. The first end portion also includes a slot 54 cut diametrically across the first end portion. The spring 46 and ball 44 are located within the bore 52 such that the spring 46 urges the ball 44 in a direction longitudinally away from the bore 52. To retain the ball 44 partially within the bore 52, the first end portion is slightly crimped to reduce the diameter of the bore at its opening onto the first end portion. The diametric slot 56 allows for this crimping action, thereby preventing complete removal of the ball 44 and spring 46 from the bore 52.

I claim:

1. An apparatus for maintaining first and second halves of an adjustable pliers in an adjusting position whereby the first and second halves of the adjustable pliers are free for sliding motion relative to one another along a path for adjusting the dimension of the pliers jaws, the apparatus comprising:

a ball-type latch connected to the first plier half and extending in a direction generally toward the second plier half, said ball-type latch being movable between first and second positions and urged toward said second position; and a plate connected to the second plier half and having a groove extending a preselected depth into said plate and along the surface of said plate substantially parallel to said adjusting path, said plate being disposed a preselected distance from said first plier half at a location approximately corresponding to the first position of said ball-type latch, and the preselected depth of said groove approximately corresponding to the second position of said ball-type latch, whereby said ball-type latch engages said groove and allows the first and second halves to slidingly adjust while being guided by said ball-type latch moving along the parallel groove.

2. An apparatus, as set forth in claim 1, wherein said ball-type latch includes a set screw having a bore extending longitudinally therein and opening onto a first end portion of said set screw, a coil spring positioned within said bore, and a ball positioned partially within said bore and urged by said coil spring in a direction away from said bore, said ball being movable between said first and second positions in response to contact with said plate and said groove respectively.

3. An apparatus, as set forth in claim 2, wherein said set screw includes a threaded exterior surface adapted to threadably engage a threaded bore extending through the first plier half, said threaded bore being located at a position in said first plier half substantially aligned with said groove when said plier halves are located in said adjusting position.

4. An apparatus, as set forth in claim 3, wherein said set screw includes a diametric slot formed into the second end portion of the set screw and is adapted to receive a tool for rotating the set screw and adjusting the position of the set screw relative to the plate.

5. An apparatus, as set forth in claim 1, wherein said plate is attached to an exterior surface of the second plier half and includes a raised portion defining a surface substantially co-planar with an interior surface of the second plier half, and said groove is formed into the co-planar plate surface.

6. An apparatus, as set forth in claim 1, wherein said plate has an exterior surface positioned in facing relationship to a path followed by said ball-type latch during pivotal movement of said first and second plier halves, said exterior plate surface being adapted to contact said ball-type latch to discourage movement of said first and second plier halves to said adjusting position 7. An apparatus for maintaining first and second halves of an adjustable pliers in an adjusting position whereby the first and second halves of the adjustable pliers are free for sliding motion relative to one another along a path for adjusting the dimension of the pliers jaws, the apparatus comprising:

a ball-type latch connected to the first plier half and extending in a direction generally toward the second plier half, said ball-type latch including a set screw having a bore extending longitudinally therein and opening onto a first end portion of said set screw, a coil spring positioned within said bore, and a ball positioned partially within said bore and urged by said coil spring in a direction away from said bore and generally toward the second plier half, said ball being movable between first and second positions and urged toward said second position; and a plate connected to the second plier half and having a groove extending a preselected depth into said plate and along the surface of said plate substantially parallel to said adjusting path, said plate being disposed a preselected distance from said first plier half at a location approximately corresponding to the first position of said ball-type latch, and the preselected depth of said groove approximately corresponding to the second position of said ball-type latch, whereby said ball engages said groove and allows the first and second halves to slidingly adjust while being guided by said ball moving along the groove.

8. An apparatus, as set forth in claim 7, wherein said set screw includes a threaded exterior surface adapted to threadably engage a threaded bore extending through the first plier half, said threaded bore being located at a position in said first plier half substantially aligned with said groove when said plier halves are manipulated to the adjusting position.

9. An apparatus, as set forth in claim 8, wherein said set screw includes a diametric slot formed into the second end portion of the set screw and is adapted to receive a tool for rotating the set screw and adjusting the position of the set screw relative to the plate.

10. An apparatus, as set forth in claim 7, wherein said plate is attached to an exterior surface of the second plier half and includes a raised portion defining a surface substantially co-planar with an interior surface of the second plier half, and said groove is formed into the co-planar plate surface.

11. An apparatus, as set forth in claim 7, wherein said plate has an exterior surface positioned in facing relationship to a path followed by said ball-type latch during pivotal movement of said first and second plier halves, said exterior plate surface being adapted to contact said ball-type latch to discourage movement of said first and second plier halves to said adjusting position 12. An apparatus for maintaining first and second halves of an adjustable pliers in an adjusting position whereby the first and second halves of the adjustable pliers are free for sliding motion relative to one another along a path for adjusting the dimension of the pliers jaws, the apparatus comprising:

a ball-type latch connected to the first plier half and extending in a direction generally toward the second plier half, said ball-type latch including a set screw having a bore extending longitudinally therein and opening onto a first end portion of said set screw, a coil spring positioned within said bore, and a ball positioned partially within said bore and urged by said coil spring in a direction away from said bore and generally toward the second plier half, said ball being movable between first and second positions and urged toward said second position; and a plate connected to the second plier half and having a groove extending a preselected depth into said plate and along the surface of said plate substantially parallel to said adjusting path, said plate being disposed a preselected distance from said first plier half at a location approximately corresponding to the first position of said ball-type latch, and the depth of said groove approximately corresponding to the second position of said ball-type latch; and said first plier half having a threaded bore extending therethrough, said threaded bore being adapted for receiving said set screw and located at a position in said first plier half so as to be substantially aligned with said groove when said plier halves are manipulated to the adjusting position, whereby said ball engages said groove and allows the first and second plier halves to slidingly adjust while being guided by said ball moving along the groove.

13. An apparatus, as set forth in claim 12, wherein said set screw includes a diametric slot formed into the second end portion of the set screw and is adapted to receive a tool for rotating the set screw and adjusting the position of the set screw relative to the plate.

14. An apparatus, as set forth in claim 12, wherein said plate is attached to an exterior surface of the second plier half and includes a raised portion defining a surface substantially co-planar with an interior surface of the second plier half, and said groove is formed into the co-planar plate surface.

15. An apparatus, as set forth in claim 12, wherein said plate has an exterior surface positioned in facing relationship to a path followed by said ball-type latch during pivotal movement of said first and second plier halves, said exterior plate surface being adapted to contact said ball-type latch to discourage movement of said first and second plier halves to said adjusting position 16. An apparatus for maintaining first and second halves of an adjustable pliers in an adjusting position whereby the first and second halves of the adjustable pliers are free for sliding motion relative to one another along a path for adjusting the dimension of the pliers jaws, the apparatus comprising:

a ball-type latch connected to the first plier half and extending in a direction generally toward the second plier half, said ball-type latch being movable between first and second positions and urged toward said second position;

a plate connected to the second plier half and having a groove extending a preselected depth into said plate and along the surface of said plate substantially parallel to said adjusting path, said plate being disposed a preselected distance from said first plier half at a location approximately corresponding to the first position of said ball-type latch, and the preselected depth of said groove approximately corresponding to the second position of said ball-type latch, whereby said ball-type latch engages said groove and allows the first and second halves to slidingly adjust while being guided by said ball-type latch moving along the parallel groove; and said plate having an exterior surface positioned in facing relationship to a path followed by said ball-type latch during pivotal movement of said first and second plier halves, said exterior plate surface being adapted to contact said ball-type latch to discourage movement of said first and second plier halves to said adjusting position.

17. An apparatus, as set forth in claim 16, wherein said ball-type latch includes a set screw having a bore extending longitudinally therein and opening onto a first end portion of said set screw, a coil spring positioned within said bore, and a ball positioned partially within said bore and urged by said coil spring in a direction away from said bore, said ball being movable between said first and second positions in response to contact with said plate and said groove respectively.

18. An apparatus, as set forth in claim 17, wherein said set screw includes a threaded exterior surface adapted to threadably engage a threaded bore extending through the first plier half, said threaded bore being located at a position in said first plier half substantially aligned with said groove when said plier halves are located in said adjusting position.

19. An apparatus, as set forth in claim 18, wherein said set screw includes a diametric slot formed into the second end portion of the set screw and is adapted to receive a tool for rotating the set screw and adjusting the position of the set screw relative to the plate.

20. An apparatus, as set forth in claim 16, wherein said plate is attached to an exterior surface of the second plier half and includes a raised portion defining a surface substantially co-planar with an interior surface of the second plier half, and said groove is formed into the co-planar plate surface.

* * * * *